US005707141A

United States Patent [19]

Yamamoto et al.

[11] Patent Number: 5,707,141

[45] Date of Patent: Jan. 13, 1998

[54] VEHICLE LAMP

[75] Inventors: Norimasa Yamamoto; Masahiro Maeda, both of Shizuoka, Japan

[73] Assignee: Koito Manufacturing Co., Ltd., Tokyo, Japan

[21] Appl. No.: 684,050

[22] Filed: Jul. 22, 1996

[30] Foreign Application Priority Data

Jul. 28, 1995 [JP] Japan ..... 7-212397

[51] Int. Cl.[6] ..... F21V 7/06

[52] U.S. Cl. ..... 362/305; 362/61; 362/309; 362/346; 362/348

[58] Field of Search ..... 362/61, 80, 215, 362/297, 304, 305, 308, 309, 326, 332, 346, 348

[56] References Cited

U.S. PATENT DOCUMENTS

| | | | |
|---|---|---|---|
| 1,903,417 | 4/1933 | Grant | 362/297 |
| 4,417,300 | 11/1983 | Bodmer | 362/304 |
| 4,459,647 | 7/1984 | Yamauchi et al. | 362/297 |
| 4,530,042 | 7/1985 | Cibie et al. | 362/309 |
| 4,779,179 | 10/1988 | Oyama et al. | 362/346 |
| 4,864,476 | 9/1989 | Lemons et al. | 362/348 |
| 4,905,133 | 2/1990 | Mayer et al. | 362/346 |
| 4,972,307 | 11/1990 | Takatsuji et al. | 362/309 |
| 5,034,867 | 7/1991 | Mayer | 362/297 |
| 5,079,677 | 1/1992 | Kumagai | 362/61 |
| 5,406,464 | 4/1995 | Saito | 362/61 |

FOREIGN PATENT DOCUMENTS

| | | |
|---|---|---|
| 334891 | 9/1930 | United Kingdom . |
| 2262980 | 7/1993 | United Kingdom . |

*Primary Examiner*—Alan Cariaso

*Attorney, Agent, or Firm*—Sughrue, Mion, Zinn, Macpeak & Seas, PLLC

[57] ABSTRACT

A vehicle lamp which includes a reflection mirror, a front lens, and a light source arranged between the reflection mirror and the front lens. The central axis of the light source is perpendicular to the principal optical axis of the reflection mirror. On the reflection mirror, there is formed a reflection surface composed of a large number of reflection steps which are defined by portions of paraboloids of revolution and are formed between adjacent ones of closed curves. The closed curves are obtained as lines of intersection between a fundamental reflection surface and a group of paraboloids of revolution composed of a large number of paraboloids of revolution having different focal distances. Centers of the group of closed curves forming the boundaries of the reflection steps are arranged at a position distant from an intersection at which the principal optical axis of the reflection mirror crosses the reflection mirror, and square lens steps are formed on the front lens. Due to the foregoing, the arrangement of the image of the light source that has been projected by the reflection steps tend to be matched with the sections of the lens steps formed on the front lens.

11 Claims, 8 Drawing Sheets

VEHICLE LAMP

BACKGROUND OF THE INVENTION

The present invention relates to a vehicle lamp such as a tail lamp, a stop lamp and a turn signal lamp, in which a tendency of the arrangement of a projected image that has been projected in front of a reflection mirror by loop-shaped reflection steps formed on the reflection surface of the reflection mirror, is matched with the sections of square lens steps formed on a front lens arranged in front of the reflection mirror.

Contemporary requirements for automobile styling are to enhance the aerodynamic characteristics and the streamline design of the automobile body. In this regard, the shapes of lamps are curved so that they are suitable for the outlines of automobile bodies, or alternatively the shapes of lamps are inclined in the upward and downward direction. This means that the lamps tend to have slanted shapes.

Due to the foregoing, the vehicle shape has a clear influence on the design of the reflection surface of a reflection mirror used in vehicle lamps. Accordingly, previously conventional shapes for the reflection surface, such as a single paraboloid of revolution, cannot be used. Non-symmetrical shapes for the reflection surface are required.

Since the front lens arranged in front of the reflection mirror would be slanted under the foregoing circumstances, it becomes necessary to assign the light distributing function, which is conventionally imposed on the front lens, to the reflection mirror. Therefore, the shape of the reflection surface has been improved by adopting a multireflection surface on which a plurality of paraboloids of revolution are combined with each other, or a plurality of minute reflection surfaces are assembled.

For example, in the case of a reflection mirror disclosed in British Patent GB 2262980, the reflection surface of the reflection mirror is composed of multi-loop-shaped reflection steps formed around the optical axis. This type reflection surface of the reflection mirror is formed as follows. First, a fundamental surface of the reflection surface is made as a free curved surface. When the reflection steps are formed on the fundamental surface, each surface of the reflection step is formed in such a manner that a tangential vector on a minute reflection surface at a reflecting point on the reflection step coincides with an outer product of a normal line vector on the minute reflection surface at the reflecting point and a normal line vector on a tangential plane of the fundamental surface at the reflecting point. In this connection, a group of closed curves, which are used as a reference in the formation of the reflection steps, can be obtained as follows. A reference line is set on the fundamental surface of the reflection surface. A plurality of reflection points are designated on the reference line. According to the law of reflection, a minute reflection surface at the point concerned is found so that a ray of incident light directed from the light source to the reflection point can be made to be parallel with the optical axis after the reflection at the point concerned. A vector computed as an outer product of a normal line vector on the minute reflection surface at the reflection point and a normal line vector on the fundamental surface at the reflection point, is adopted as a directional vector to determine a direction of the formation of the reflection step. A closed curve is generated by means of a spline approximation in which the directional vectors at a plurality of reflection points around the optical axis are used as tangential vectors. In this way, a group of closed curves can be obtained as a set of closed curves at an arbitrary reflection point.

In this connection, in the lamp in which the above reflection mirror is used, it is necessary for the sections of the lens steps formed on the front lens to be matched with the projected pattern which is a set of projected images of the light source formed by the reflection steps of the reflection mirror. In practice, it has been very difficult to control rays of light in the lens steps. Further, there is a problem with aesthetics in that the lamp is not attractive when it is viewed in a direction from the front lens to the reflection mirror during the lighting of the lamp.

In the above reflection mirror, under the condition that the principal optical axis always passes through the center of a group of the closed curves, the closed curves are formed around the principal axis like the shape of finger print, and each reflection step is formed along each closed curve. On the assumption that the ideal shape of the filament of a light bulb is columnar, when a large number of reflection points are set on one of the reflection steps and rays of light are traced with respect to projected images, the axes of the projected images in the longitudinal direction are not put in order, but they are extended in the radial direction.

Due to the foregoing, the projection pattern, which is a set of projected images, becomes circular. Accordingly, it is necessary to design the shapes of the steps of the front lens so that they can be fitted to the circular projected patterns. In practice, a substantial amount of time and labor is required to design such lens steps.

For example, when the front lens is divided into small grid-shaped sections and a fish-eye lens is formed in each grid section, the shape of the projection pattern is not matched with the lens steps; in such case, the shape of the pattern is square when seen from the front of the lamp. This causes problems in that the shapes of the reflection steps are conspicuous and unattractive in the case where there is false lighting caused by external light. In order to solve the above problems, it is necessary to attach an inner lens between the front lens and the reflection mirror.

SUMMARY OF THE INVENTION

The present invention is intended to provide a vehicle lamp comprising: a reflection mirror having a reflection surface composed of a large number of reflection steps which are defined by portions of respective paraboloids of revolution and are formed between adjacent ones of closed curves, the closed curves being obtained as lines of intersection of a group of paraboloids of revolution having different focal distances and a fundamental reflection surface; a front lens arranged in front of the reflection mirror; a light source arranged on a principal optical axis of the reflection mirror so that a central axis of the light source is arranged to be perpendicular to the principal optical axis of the reflection mirror, wherein a center of the group of closed curves forming the boundaries of the reflection steps is arranged at a position distant from an intersection at which the principal optical axis of the reflection mirror crosses the reflection mirror, and the lens step are formed in substantially square regions on the front lens.

Consequently, according to the present invention, when the center of a group of closed curves, that define the boundaries of reflection steps, is set at a position distant from the intersection of the principal optical axis of the reflection mirror and the reflection surface, the projected image of the light source formed by one reflection step is substantially put in order in the horizontal or vertical direction, so that the shape of the projected pattern, which is a set of images, becomes square or substantially square.

Accordingly, the shape of the projected pattern is matched with the grid-shaped section of the lens step formed on the front lens.

DETAILED DESCRIPTION THE INVENTION

The lamp of the present invention will be described as follows.

Figure 1:
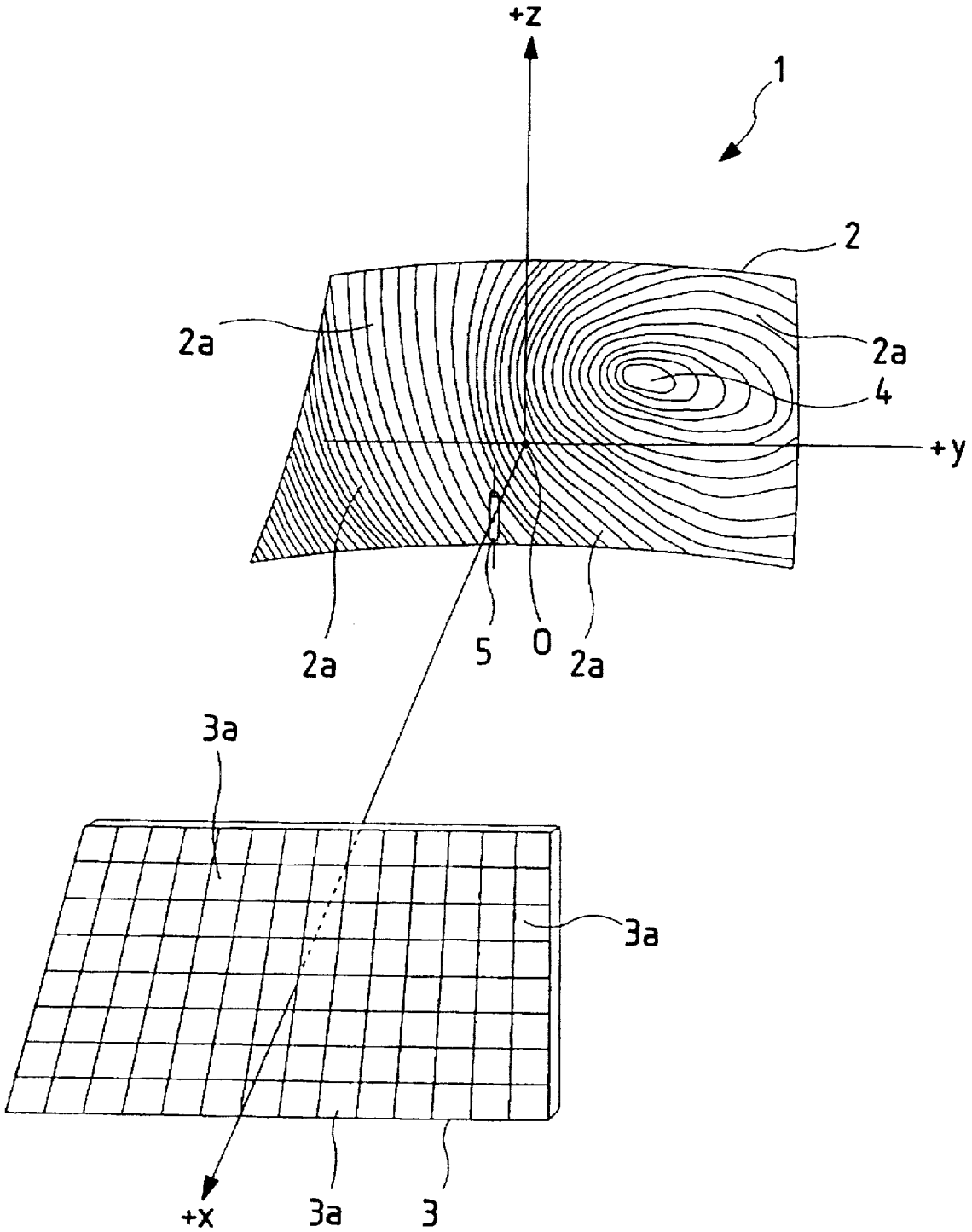
FIG. 1 is a schematic perspective view showing an arrangement of a vehicle lamp according to the present invention.

As schematically shown in FIG. 1, a vehicle lamp 1 is composed of a reflection mirror 2 and a front lens 3 arranged in front of the reflection mirror 2. In this connection, the x-axis shown in FIG. 1 represents a principal optical axis of the reflection mirror 2, the y-axis represents a horizontal axis perpendicular to the x-axis, and the z-axis represents a vertical axis perpendicular to the x-axis and the y-axis.

On the reflection mirror 2, there are provided a large number of loop-shaped reflection steps 2*a*, 2*a*, . . . . This reflection mirror is characterized in that a center 4 of these loops is formed at a position distant from the intersection, which is referred to as "point 0" hereinafter, of the x-axis and the reflection mirror 2.

In front of the reflection mirror 2, there is provided a light source 5 on the x-axis, which is composed of a filament of a light bulb or an arc of an electric discharge lamp. On the front lens 3 arranged in front of the light source 5, there are provided a large number of lens steps 3*a*, 3*a*, . . . in the regions that are divided into substantial squares when they are seen from the front of the lamp. In this connection, in the drawing, the shape of the lens step 3*a* is a substantial grid-shape, however, it should be noted that the shape of the lens step 3*a* is not limited to the specific embodiment, but the shape of the lens step 3*a* may be formed into a rectangle which is long either longitudinally or transversely. The outer shape of the reflection mirror 2 or the front lens 3 is not limited to a square, but it may be circular or round.

FIGS. 2 to 6 are views showing a method of forming the reflection mirror 2.

Figure 2:
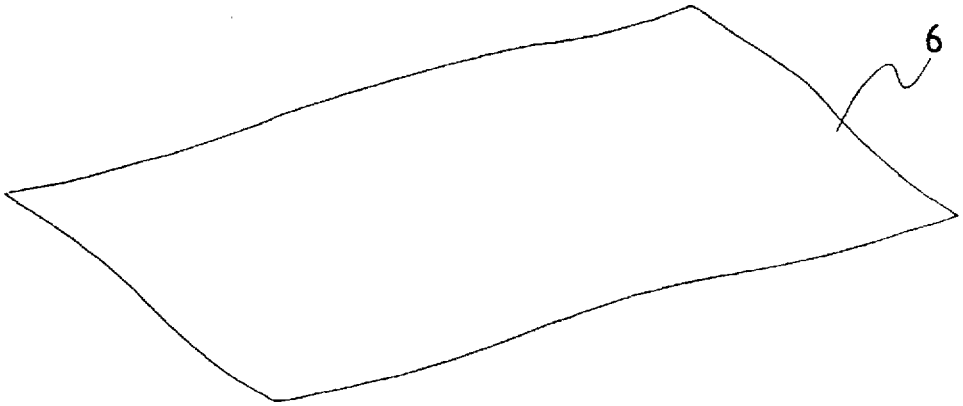
FIG. 2 is a view for explaining a method of forming a reflection surface of the present invention, wherein this view shows a free curved surface which is the fundamental surface.

First, as shown in FIG. 2, a curved surface 6 to define a fundamental shape of the reflection surface is set. For example, this curved surface is made in the system of CAD (Computer Aided Design) as a free curved surface that can not be expressed by an analytic expression.

Figure 3:
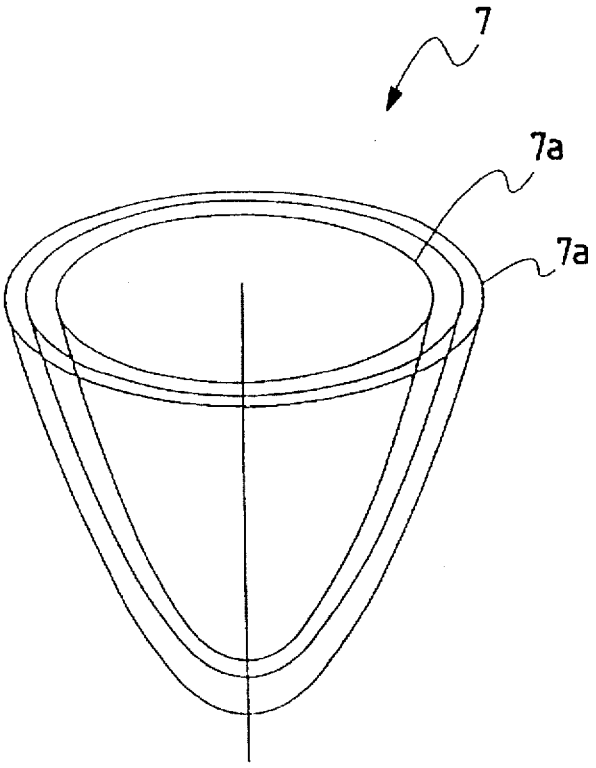
FIG. 3 is a view showing a group of paraboloids of revolution.

Next, as shown in FIG. 3, a group of curved surfaces 7 to define the performance of the reflection surface are prepared. This group of curved surfaces 7 are composed of a large number of paraboloids of revolution 7*a*, 7*a*, . . . having a common symmetrical axis of revolution, and the focal distances of these surfaces of paraboloid of revolution 7*a*, 7*a*, . . . are different from each other. These paraboloids of revolution 7*a*, 7*a*, . . . do not cross each other spatially. In this connection, the focuses of the surfaces of paraboloid of revolution 7*a*, 7*a*, . . . do not necessarily coincide with each other. For example, the focus of each surface of the paraboloids of revolution may be located at a position in a certain range on the symmetrical axis of revolution.

Figure 4:
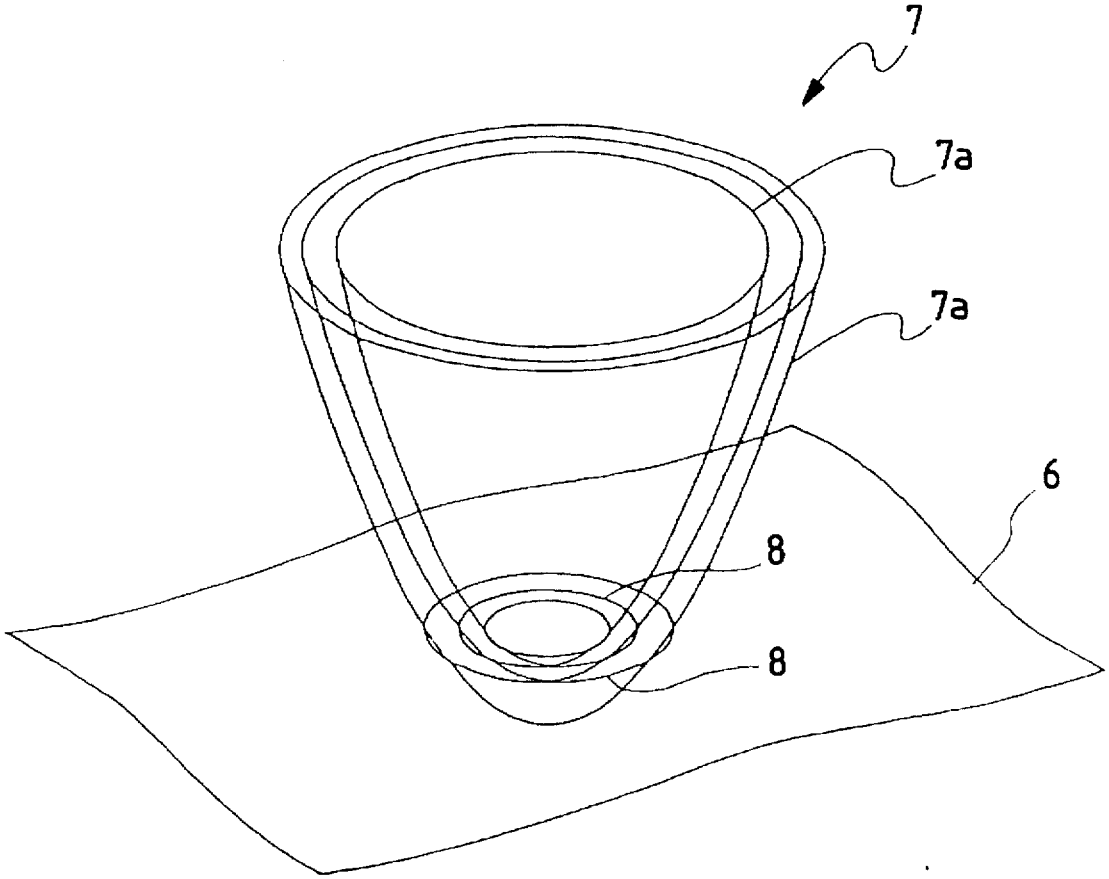
FIG. 4 is a view showing a group of closed curves obtained as lines of intersection of a group of paraboloids of revolution and the fundamental surface.

As shown in FIG. 4, lines of intersection 8 of the above curved surface 6 and the group 7 of curved surfaces are determined. These lines of intersections 8 constitute closed curves or portions of the closed curves. These lines of intersection 8 do not cross each other on the curved surface 6. When the curved surface 6 has a symmetrical revolving axis, the center of the group of the closed curves composed of the lines of intersection 8 is located at the intersection of the symmetrical axis of revolution and the curved surface 6. However, when the curved surface 6 has no axis of revolution, it is determined by a position of the point where one of the paraboloids of revolution composing the group of the of paraboloids of revolution comes into contact with the curved surface 6. Accordingly, the center of the group of paraboloids of revolution is distant from the intersection of the principal optical axis of the reflection mirror 2 and the curved surface 6.

Figure 5:
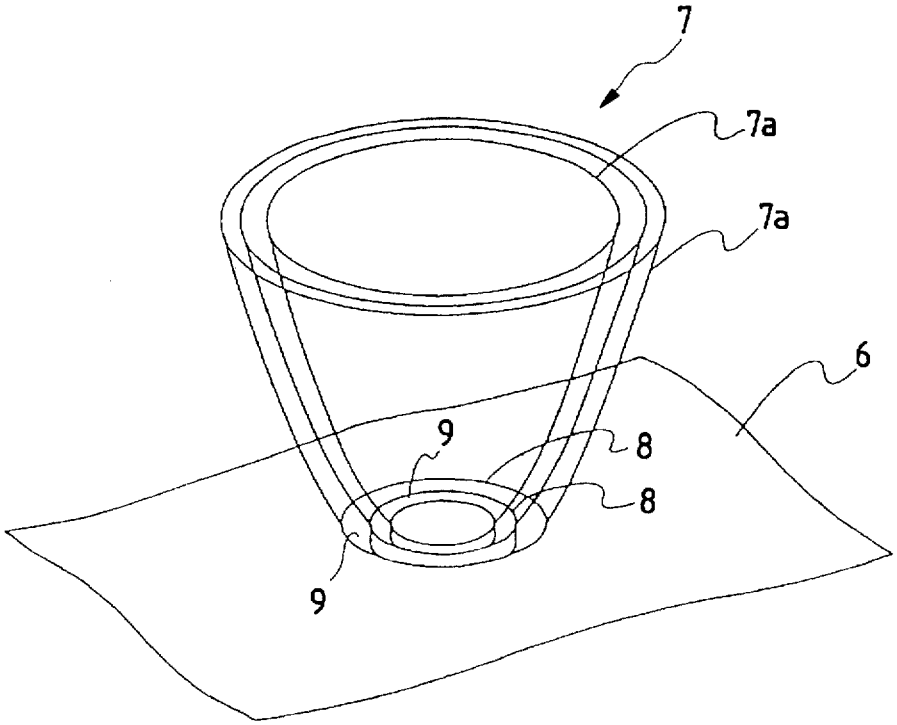
FIG. 5 is a view for explaining the formation of reflection steps.

After the lines of intersection 8 have been determined as described above, the reflection steps are formed in accordance with the lines of intersection. The reflection steps 9 defined by portions of the paraboloids of revolution are formed between adjacent ones of the lines of intersection as shown in FIG. 5.

Figure 6:
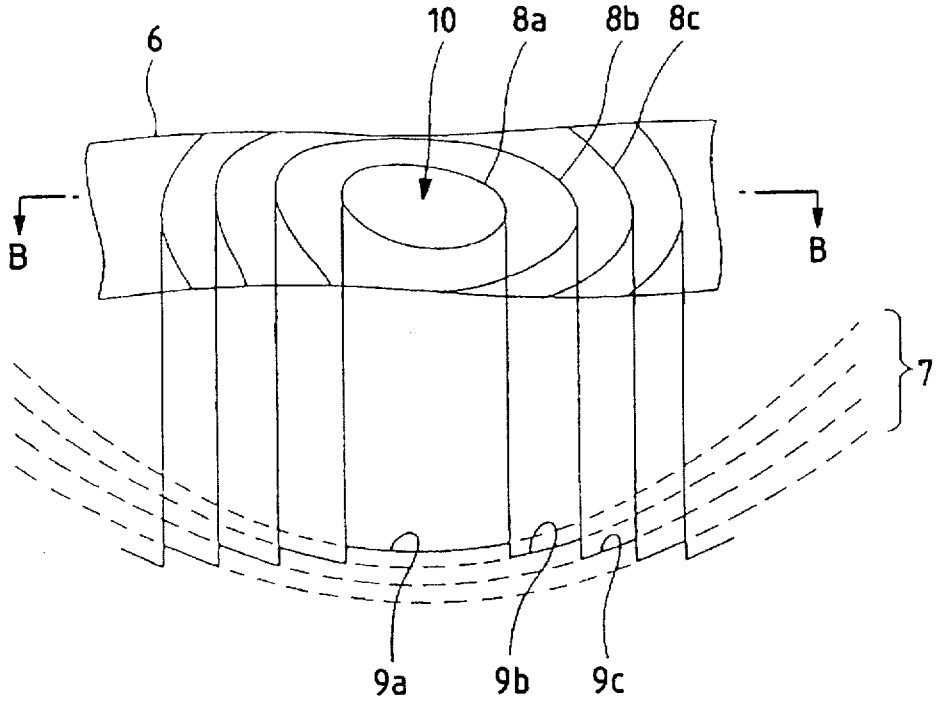
FIG. 6 is a view showing a front shape and a cross-section of the reflection surface.

FIG. 6 is a view in which a front view of the curved surface 6 is arranged in the upper portion, and a schematic cross-sectional view taken on line B—B in the front view is; arranged in the lower portion. The lines of intersection on the curved surface 6 are successively denoted by 8*a*, 8*b*, 8*c* . . . from one close to the center 10 of the group of closed curves. These lines of intersection appear as the boundaries-of the reflection steps. In this connection, broken lines on the drawing represent the group of curved surfaces 7. The reflection step 9*a* is formed in an inner region defined by the line of intersection 8*a*. The reflection step 9*b* is formed in an inner region between the lines of intersection 8*a* and 8*b*. The reflection step 9*c* is formed in an inner region between the lines of intersection 8*b* and 8*c*. In this way, the shapes of the reflection steps are determined. That is, the effective reflection surfaces of individual reflection steps are formed in such a manner that the effective reflection surfaces form portions of the paraboloids of revolution 7*a*. In this case, sections of the effective reflection surfaces of individual reflection steps are formed like a stair case.

A reflection mirror having the reflection surface provided with the above reflection steps is made by using a CAD system. Based on this design, a metallic mold of the reflection mirror can be obtained by using CAM (Computer Aided Manufacturing) to obtain the necessary data.

Figure 8:
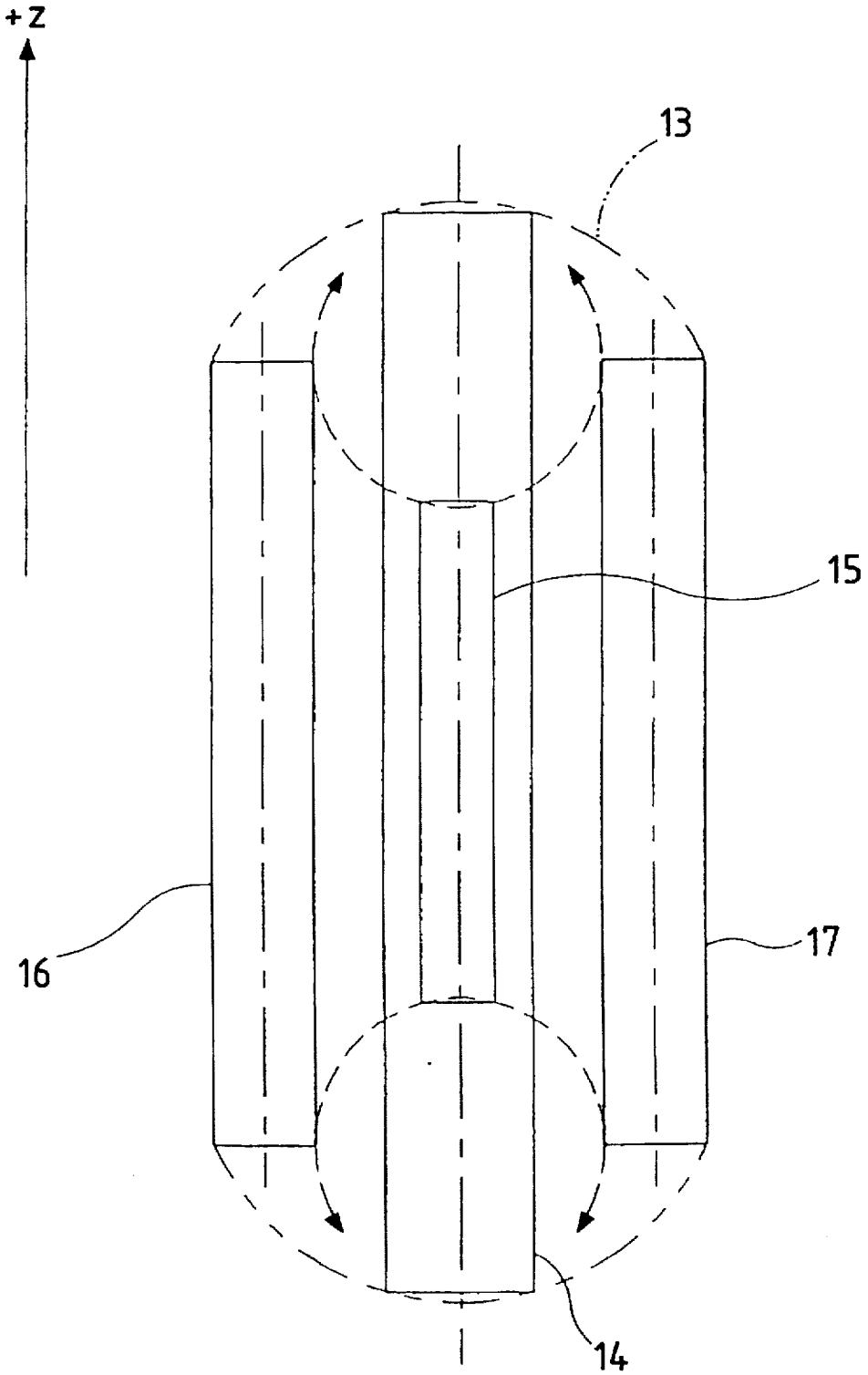
FIG. 8 is a schematic illustration for explaining a projection pattern projected forward by one reflection step of the reflection mirror shown in FIG. 7.

FIG. 8 is a view showing an arrangement of the image of the light source that is projected from several reflection points that are set on one reflection step that forms a part of the reflection surface of the reflection mirror.

Figure 7:
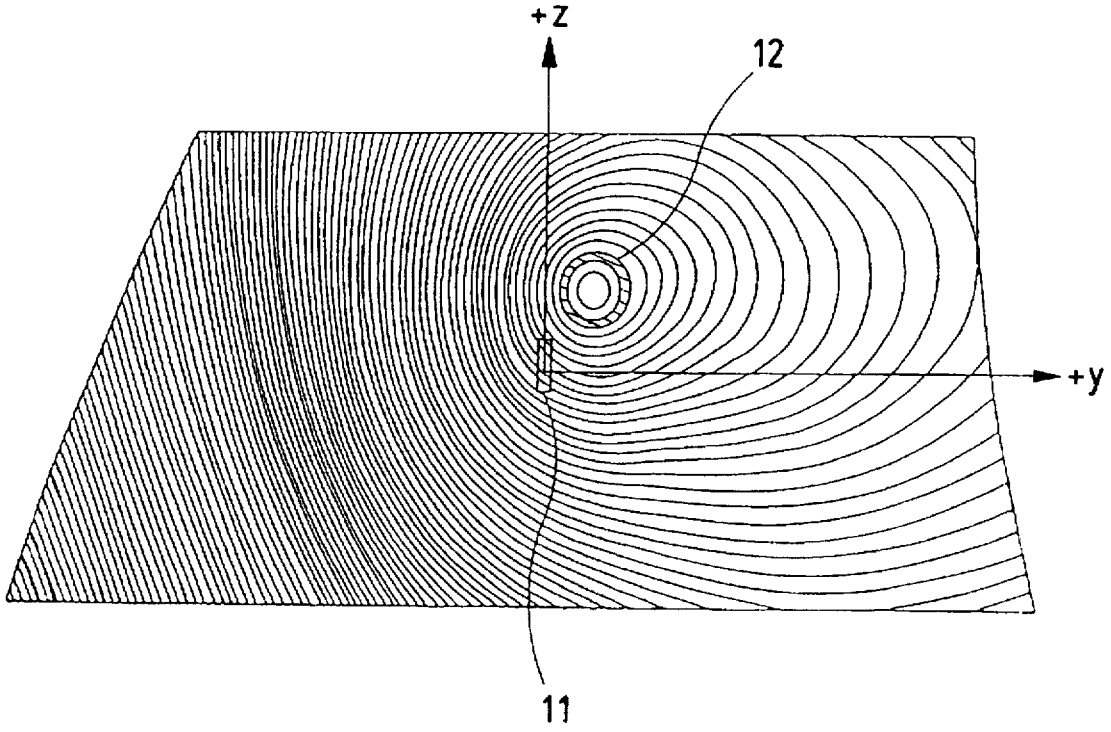
FIG. 7 is a front view showing an example of the light source arrangement with respect to the reflection mirror.

In this case, it is assumed that the ideal shape of the filament 11 of the electric bulb of the light source is columnar. As shown in FIG. 7, when a view is taken from the front of the filament 11, the central axis of the filament 11 is perpendicular to the x-axis and extends in the direction of the z-axis, and the center of the filament 11 is located on the x-axis.

As shown by a hatched portion in FIG. 7, the objective reflection step 12 is an annular portion located at an upper right oblique position of the filament 11 when the view is taken from the front. When reflection points are set on the reflection step 12 and a ray of light is traced with respect to each reflection point, a projection pattern 13 is obtained as a set of the filament images as shown in FIG. 8.

The filament images 14 to 17 express a portion of the filament image comprising the projection pattern 13. The filament image 14, the projection area of which is large, is an image in the case of reflection in which a distance from the filament 11 to the reflection point is short. The filament image 15, the projection area of which is small, is an image in the case of reflection in which a distance from the filament 11 to the reflection point is long. The filament images 16, 17 located on both sides of the filament images 14, 15 are images in the case of reflection in which a distance from the filament 11 to the reflection point is intermediate.

These filament images 14 to 17 extend in the direction of the z-axis under the condition that the longitudinal central axes of the filament images are arranged in parallel with each other. Therefore, a square projection pattern, the corners of which are round, is formed as a whole.

The filament images, the longitudinal central axes of which are arranged in parallel with each other, are suitable for the lens steps 3*a* that are divided into substantial squares when light distribution is controlled, as seen in FIG. 1. In this case, actions to be conducted by the lens steps are to diffuse the filament images in the longitudinal direction, to diffuse the filament images in the direction perpendicular to the longitudinal direction, and to control the degree of diffusion. For example, when fish-eye lens steps are used as the lens steps 3*a*, it is easy to change the degree of diffusion in the horizontal/vertical direction of the projection pattern by controlling the radius of curvature on the horizontal section and/or vertical section of each fish-eye lens step.

The projection pattern 13 formed by the reflection step 12 is a substantial square which extends along the longitudinal central axis of the filament image comprising the projection pattern. Therefore, the shape of the projection pattern 13 is matched with the section of the lens step 3*a*. Accordingly, the lamp looks well when it is being turned on, without providing an inner lens between the reflection mirror 2 and the front lens 3.

In this connection, in FIG. 8, the central axis of the filament 11 is perpendicular to the x-axis and extends in the direction of the z-axis, so that the longitudinal central axes of the filament images 14 to 17 extend substantially in the vertical direction. However, when the filament 11 is arranged in such a manner that the central axis of the filament 11 is perpendicular to the x-axis and extends in the direction of the y-axis, it is possible to arrange the filament image in such a manner that the longitudinal central axis of the filament image extends substantially in the horizontal direction.

Figure 9:
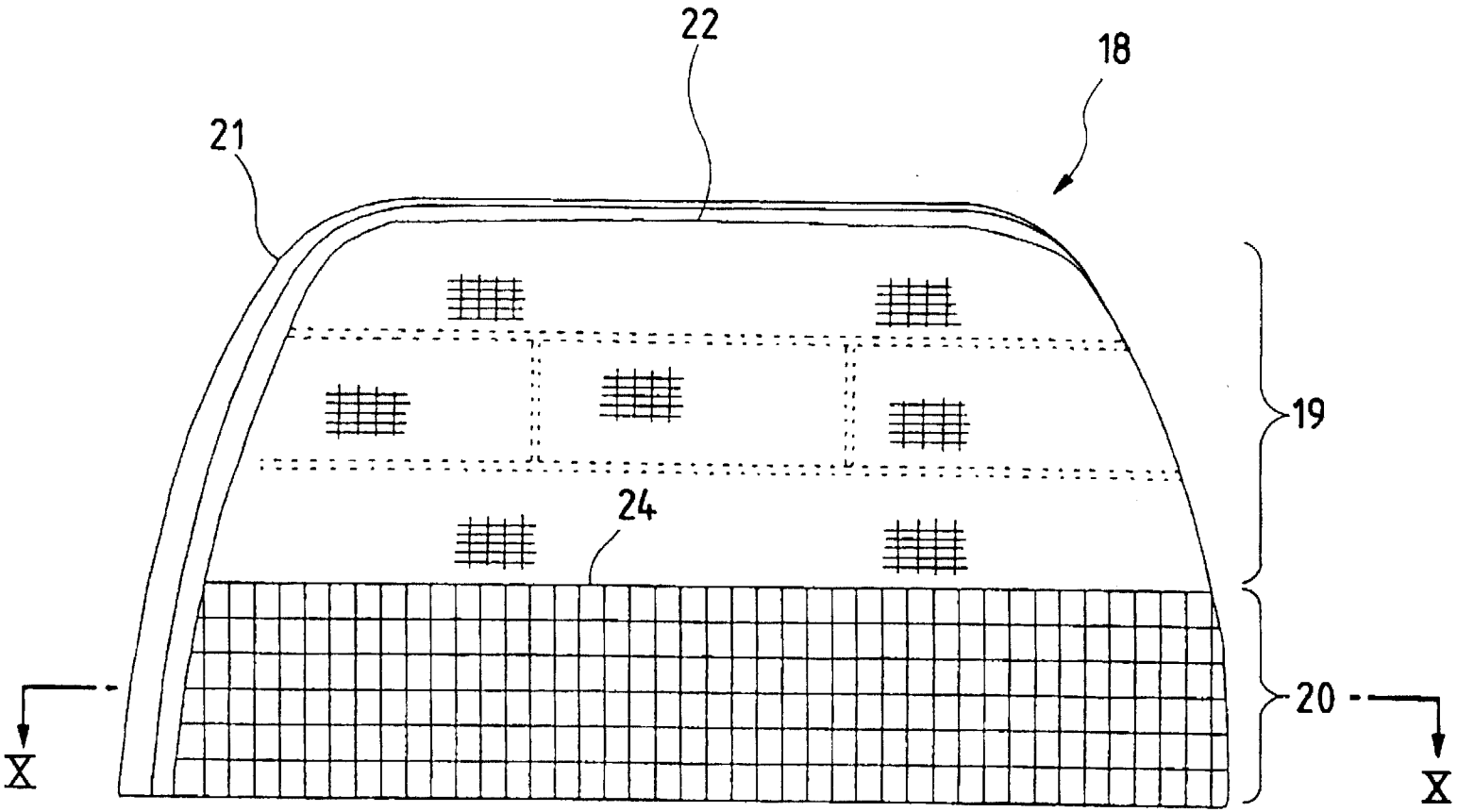
FIG. 9 is a front view of the lamp, which is an example of the present invention.
Figure 10:
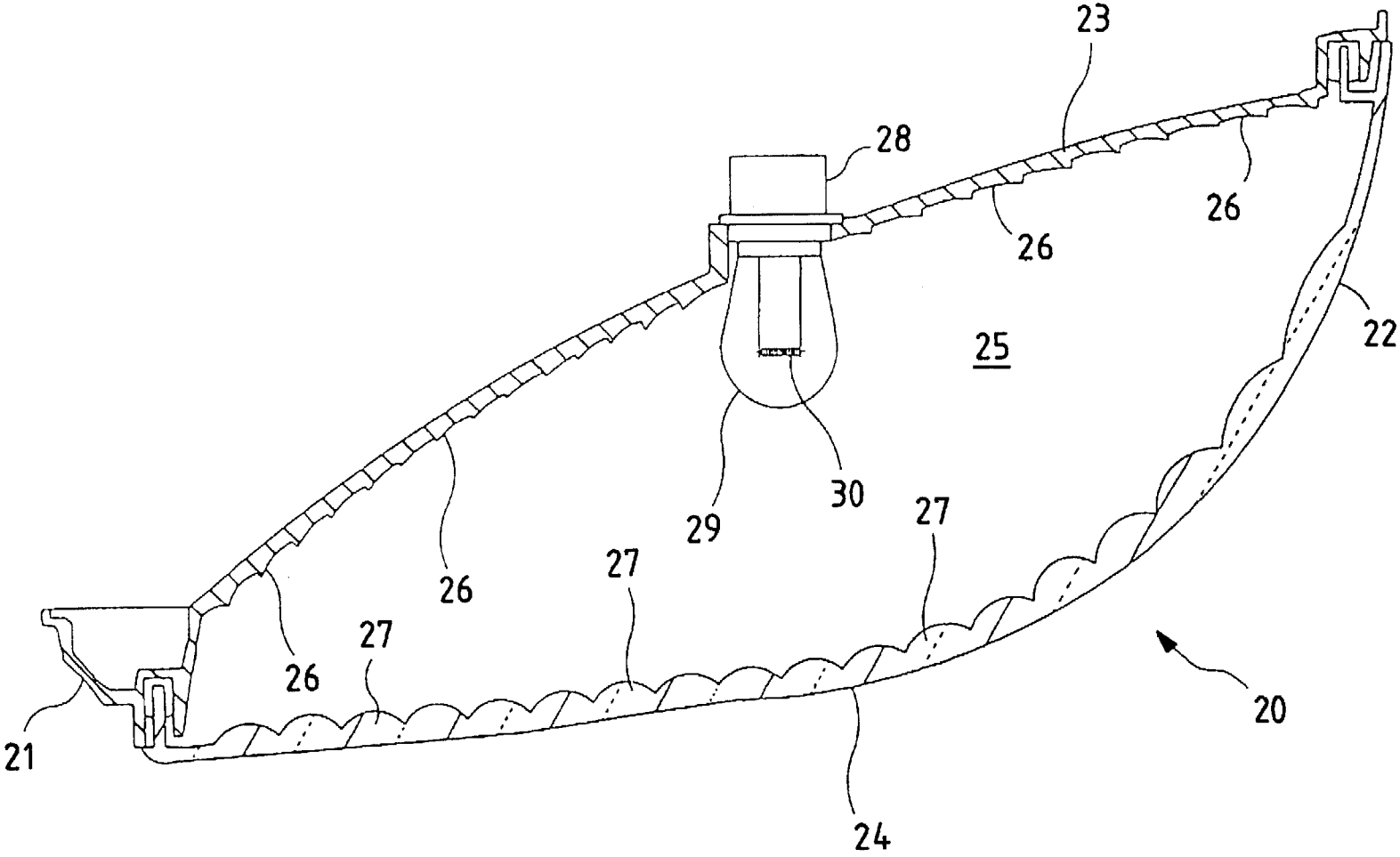
FIG. 10 is an enlarged cross-sectional view taken on line X—X in FIG. 9.

FIGS. 9 and 10 are views showing an example 18 of the vehicle lamp according to the present invention. In this example, the lamp of the present invention is applied to a rear combination lamp for automobile use.

As shown in FIG. 9, the lamp 18 includes: a tail and stop lamp portion 19 that occupies an upper portion, the area of which is about two thirds of the overall lamp; and a turn signal lamp portion 20 that occupies a lower portion, the area of which is about one third of the overall lamp.

A lamp space of the vehicle lamp 18 is defined by a lamp body 21 made of synthetic resin and a front lens 22 attached to the lamp body 21 in such a manner that the front lens 22 covers the front portion of the lamp body 21. In this case, the light illuminating direction is defined as a front direction. As described above, the lamp space is defined by the two parts.

In this example, the above arrangement of the vehicle lamp 1 is applied to a turn signal lamp portion 20.

FIG. 10 is a view showing a horizontal cross-section of the turn signal lamp portion 20. The lamp space 25 is defined by a reflection portion 23 composing the turn signal portion of the lamp body 21, and a lens portion 24 of the front lens 22 located in the front of the reflecting portion 23.

A reflection surface of the reflecting portion 23 is composed of the aforementioned multi-loop shaped reflection steps 26 which undergo a reflecting treatment such as reflecting coating or aluminum vapor-deposition. In this connection, the center of a group of closed curves defining the boundaries of the reflection steps 26 is located at a position distant from the intersection at which the principal optical axis of the reflecting portion 23 crosses the reflecting portion 23.

The lens portion 24 is divided into a large number of grid-shaped regions when a view is taken from the front. There are provided fish-eye lenses 27 in these grid-shaped regions.

The electric bulb 28 includes a glass ball 29 and a filament 30 arranged in the glass ball. The electric bulb 28 is attached to the reflecting portion 23 by a means not shown in the drawing under the condition that a central axis of the filament 30 is perpendicular to the principal optical axis of the reflecting portion 23 and extends in the horizontal direction.

In the above explanation, the number of the centers of a group of closed curves is only one. However, even when the number of the centers of a group of closed curves is plural, of course, it is necessary that each center of the closed curve is located at a position distant from an intersection where the principal optical axis of the reflection mirror crosses the reflection surface.

As can be seen in the above explanations, according to the present invention, when a view is taken in the direction of the principal optical axis of the reflection mirror, the lens steps formed in the substantially square regions on the front lens are matched with the projected image of the light source formed by the reflection steps of the reflection mirror. Accordingly, only when lens steps of simple shapes are arranged on the front lens in orderly rows, without using additional parts such as an inner lens, rays of reflecting light can be easily controlled. Further, when the reflection mirror is seen from the front lens, the lamp has a grid appearance.

What is claimed is:

1. A vehicle lamp comprising:

a reflection mirror having a principal optical axis and comprising a reflection surface composed of a plurality of reflection steps which are defined by portions of paraboloids of revolution and formed between adjacent ones of closed curves, said closed curves being defined as lines of intersection between a group of paraboloids of revolution having a common axis but different focal distances and a fundamental surface for the reflection surface;

a front lens arranged in front of the reflection mirror; and a light source arranged on said principal optical axis of the reflection mirror such that a central axis of said light source is perpendicular to said principal optical axis of the reflection mirror;

wherein centers of the group of closed curves forming boundaries of the reflection steps are arranged at a position distant from an intersection at which the principal optical axis of the reflection mirror crosses the reflection mirror, and said front lens comprises lens steps in substantially square regions.

2. A vehicle lamp as claimed in claim 1, wherein said front lens steps are assembled in a grid arrangement.

3. A vehicle lamp as claimed in claim 1, wherein said vehicle lamp comprises at least two of a tail, stop and turn portions.

4. A vehicle lamp as claimed in claim 1, wherein said light source comprises a filament and the central axis of said filament is perpendicular to the principal optical axis of said reflecting mirror and extends in a horizontal direction.

5. A vehicle lamp as claimed in claim 1, wherein said light source comprises a filament and said reflection steps project images of said filament having a longitudinal central axis, said filament being oriented such that the longitudinal central axis of said images extend substantially in one of the horizontal or vertical directions.

6. A vehicle lamp as claimed in claim 5, wherein said filament images formed by each said reflection step comprises substantially a rectangle which extends along said longitudinal central axis of said filament image.

7. A vehicle lamp as claimed in claim 5, wherein said lens steps are shaped to diffuse said filament images in a longitudinal direction.

8. A vehicle lamp as claimed in claim 5, wherein said lens steps are shaped to diffuse said filament images in a direction orthogonal to said longitudinal central axis.

9. A vehicle lamp as claimed in claim 5 wherein said lens steps are shaped to control the degree of diffusion of said filament images.

10. A vehicle lamp as claimed in claim 5 wherein said lens steps comprise fisheye steps having a predetermined radius of curvature on at least one of said horizontal section and said vertical section.

11. A vehicle lamp as claimed in claim 2, wherein the shape of said lens steps in said grid substantially match the images reflected from corresponding reflecting steps.

* * * * *